US006363555B1

(12) United States Patent
LaRose

(10) Patent No.: US 6,363,555 B1
(45) Date of Patent: Apr. 2, 2002

(54) PATIENT POSITIONING APPARATUS

(76) Inventor: Paul E. LaRose, 128 Chanteclair Cir., Gulf Breeze, FL (US) 32561

( * ) Notice: Subject to any disclaimer, the term of this patent is extended or adjusted under 35 U.S.C. 154(b) by 0 days.

(21) Appl. No.: 09/484,511

(22) Filed: Jan. 18, 2000

(51) Int. Cl.[7] ..... A61G 13/00; A61G 7/00

(52) U.S. Cl. ..... 5/600; 5/81.1 C; 5/81.1 R; 5/488

(58) Field of Search ..... 5/600, 488, 81.1 R, 5/81.1 C, 81.1 HS, 658

(56) References Cited

U.S. PATENT DOCUMENTS

| | | | | | |
|---|---|---|---|---|---|
| 1,877,610 | A | * | 9/1932 | Steiner | 5/488 |
| 3,343,183 | A | * | 9/1967 | Sannes | 5/488 |
| 3,388,406 | A | * | 6/1968 | Scrivener | 5/488 |
| 3,612,509 | A | | 10/1971 | Boston et al. | 5/600 |
| 3,641,600 | A | * | 2/1972 | Oats | 5/488 |
| 3,794,313 | A | * | 2/1974 | Berger et al. | 5/488 |
| 4,109,329 | A | | 8/1978 | Tupper | 5/607 |
| 4,305,167 | A | * | 12/1981 | Bargados | 5/488 |
| 4,540,165 | A | | 9/1985 | Green et al. | |
| 4,674,626 | A | | 6/1987 | Adcock | |
| 4,773,637 | A | | 9/1988 | Jarin | 5/600 |
| 4,799,273 | A | * | 1/1989 | Elze | 5/81.1 C |
| 4,944,053 | A | | 7/1990 | Smith | |
| 4,984,681 | A | | 1/1991 | Jonkers | |
| 5,390,379 | A | * | 2/1995 | Palmer, Jr. et al. | 5/81.1 C |
| 5,860,174 | A | * | 1/1999 | Failor | 5/81.1 HS |

* cited by examiner

*Primary Examiner*—Alexander Grosz
(74) *Attorney, Agent, or Firm*—Luedeka, Neely & Graham PC

(57) ABSTRACT

The invention provides a patient positioning apparatus for attachment to a patient examination table having a table pad and pad cover. The apparatus comprises a first table attachment device containing a first reel member and a first reel rotatably mounted on the first reel member, a second table attachment device containing a second reel member and a second reel rotatably mounted on the second reel member, an elongate web attached to at least one of the reel members for overlaying the table pad and pad cover of the examination table and a drive mechanism connected to at least the reel member attached to the web for rotating said reel member attached to the web thereby moving the web relative to the pad cover. The device is readily adaptable to existing examination tables and enables a physician to easily maneuver a patient for examination.

17 Claims, 5 Drawing Sheets

PATIENT POSITIONING APPARATUS

The invention relates to a device for positioning a patient and more particularly to an apparatus for attachment to a lithotomy table for moving a patient during an examination procedure.

BACKGROUND

In the lithotomy position, a patient typically has her legs bent at an acute angle and her feet in metal stirrups so as to expose the regions of her anatomy to be examined. During examination, it is typically necessary for the patient to be repositioned in order to use particular examination instruments or to expose portions of the patient's anatomy required for proper examination. However, it is often cumbersome for the patient to move herself while on the examination table and sometimes the movement is not enough or is too much. For heavy or elderly patients or patients suffering from arthritis, it is likewise difficult for the patient to move or properly reposition herself on the examination table. Weak or elderly patients are particularly susceptible to muscular cramps as they attempt to reposition themselves. When the patient is unable to move herself properly, the physician must cease whatever examination procedure he is performing and attempt to or help reposition the patient. Whether the patient herself or the physician attempts the repositioning movement, it interrupts the examination procedure thus prolonging the examination.

There is a need therefore for a relatively simple, and relatively inexpensive means for easily repositioning a patient during an examination procedure.

SUMMARY OF THE INVENTION

With regard to the foregoing and other objects and advantages, the invention provides a patient positioning apparatus for attachment to a patient examination table having a table pad and pad cover. The apparatus comprises a first table attachment device containing a first reel member and a first reel rotatably mounted on the first reel member, a second table attachment device containing a second reel member and a second reel rotatably mounted on the second reel member, an elongate web attached to at least one of the reel members for overlaying the table pad and pad cover of the examination table and a drive mechanism connected to at least the reel member attached to the web for rotating said reel member attached to the web thereby moving the web relative to the pad cover.

In another embodiment, the invention provides a method for examining a patient in a lithotomy position. The method includes providing a patient positioning apparatus for attachment to a patient examination table having a table pad and pad cover, the apparatus containing a first table attachment device containing a first reel member and a first reel rotatably mounted on the first reel member, a second table attachment device containing a second reel member and a second reel rotatably mounted on the second reel member, an elongate web attached to at least one of the reel members for overlaying the table pad and pad cover of the examination table and a drive mechanism connected to at least the reel member attached to the web for rotating said reel member attached to the web thereby moving the web relative to the pad cover; attaching the patient positioning apparatus to opposing ends of a patient examination table; placing the patient on the positioning apparatus in an examination position; operating a drive mechanism to rotate at least one of the reel members in order to move the web relative to the pad cover thereby effectively repositioning the patient.

Advantages of the invention are that the device is relatively simple, has relatively few moving parts and can readily be attached to a conventional patient examination table with little effort and expense. The device provides a convenient method for repositioning a patient with less patient discomfort and less strain on the part of the examining physician or patient. Furthermore, the components of the device are relatively reliable and suitable for long term use. Because the drive mechanism directly engages the reel members there are fewer moving parts and less need for mechanism adjustments such as required for chain drive mechanisms which may stretch over time and become slack.

BRIEF DESCRIPTION OF THE DRAWINGS

Other features and advantages of the invention are described herein with reference to the following drawings in which.

DETAILED DESCRIPTION OF THE PREFERRED EMBODIMENTS

Figure 1:
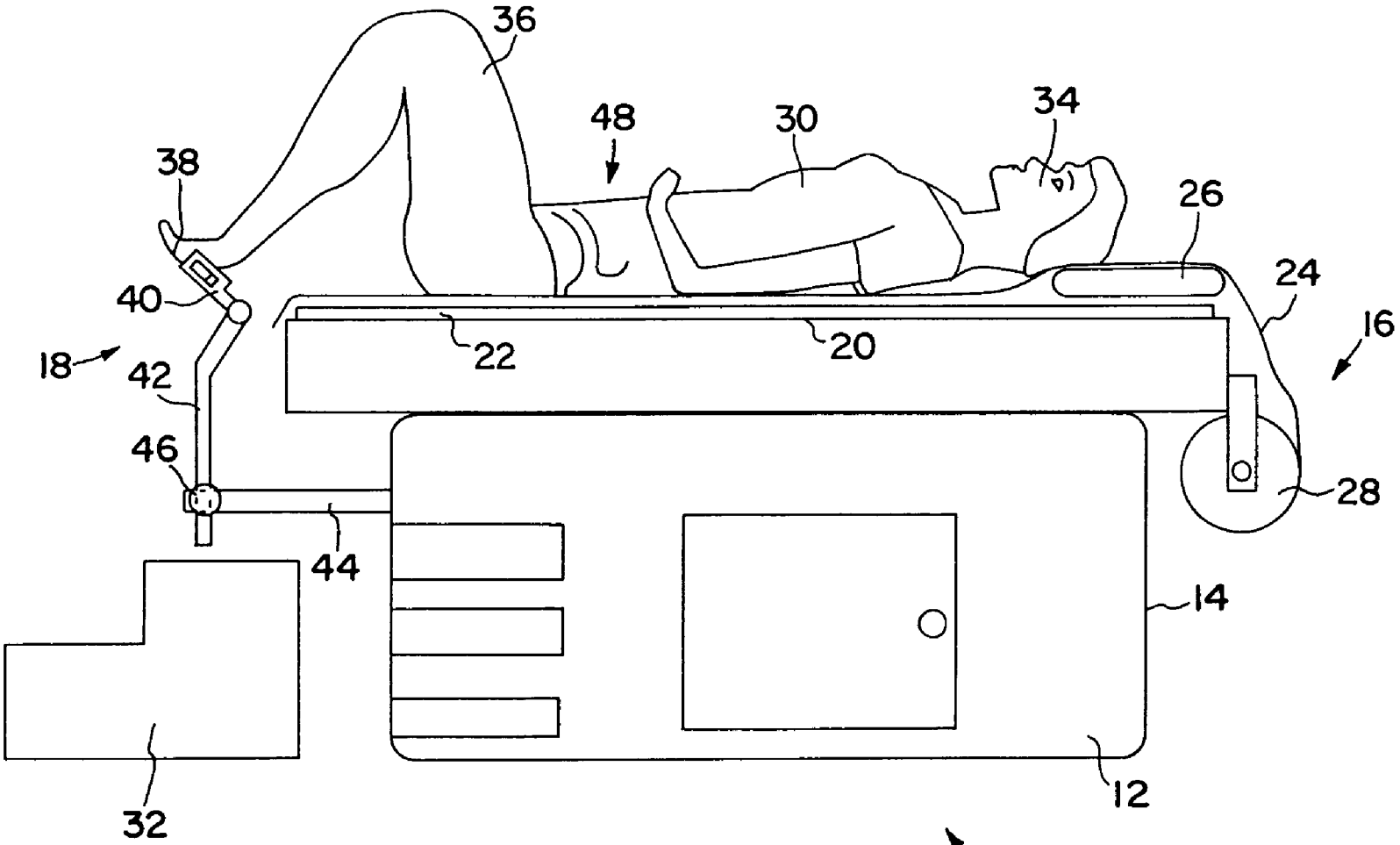
FIG. 1 is a perspective view of a conventional patient examination table.

With reference to FIG. 1, there is shown in perspective view a conventional patient examination table 10 including a table base 12 defined by sides 14, first end 16 and second end 18 supporting a table top 20 having a cushioned pad 22 and pad cover 24. A pillow 26 may be included for additional patient comfort. The cover 24 is typically an elongate paper web which is unrolled from one end of the table such as first end 16 from a web supply reel 28. In the case of a paper web, the cover 24 is disposed of at the termination of the examination procedure.

During an examination, a patient 30 may use step 32 to position herself in a reclining position on the top 20 of the examination table 10 so that the her head 34 is adjacent the pillow 26 and the her legs 36 are bent so that her feet 38 are flat on the top 20 of the table 10. In the alternative, her legs may be supported by inserting her feet in stirrups 40. The stirrups 40 are attached to extendable rods 42 adjacent second end 18 of the table 10. Rod support arms 44 are slidably extendable from the second end 18 of table base 12. The stirrup height may be adjusted moving rods 42 upwardly or downwardly with respect to support arms 44 and fixing the position of the rods 42 by tightening adjustment knobs 46 when the rods 42 and stirrups 40 attached thereto are at the desired height. Other support means may be used and the design of the patient leg and foot support apparatus may be varied as these features are readily available and are not intended to limit the invention in any way.

During an examination of an intercrural portion of a patients anatomy, it may be necessary for the examining physician to reposition the patient's lower torso 48 with respect to second end 18 of the table 10. In the case of a conventional examination table 10, the patient 30 must assist the physician by raising her torso 48 and/or bending or straightening her legs 36 in order to move relative to second end 18 of the table 10. Such a maneuver is relatively cumbersome for a young patient and extremely difficult for an older patient or for a patient with physical impairments. It is often difficult for a patient 30 to properly judge the movement required and because the patient 30 is often positioned near the end of the examination table 10, a patient 30 may fear falling off the second end 18 of the table 10 by moving too much. Accordingly, the physician, who is in the best position to judge the movement of the patient has the burden of making most of the patient readjustments.

While a physician may be manually able help adjust the patient's torso 48 in most instances, for large patients or heavy patients, the physician may not be strong enough to accomplish the desired movement. Furthermore, during actual examination, the physician may require minute repositioning of the patient's torso 48 which requires the physician to cease the examination while he helps the patient 30 move to the correct examination position.

In order to assist in examination of a patient, an apparatus has been devised which can be readily adapted for use on conventional examination tables to mechanically reposition a patient 30 for examination. Once the patient 30 has been maneuvered to the proper examining position, the physician is free to use and manipulate any examination instruments he may choose to use without the second end 18 of the table 10 interfering with the instrument. Furthermore, since the physician is able to easily move the patient 30 using the apparatus 50 of the invention with little or no patient interaction, the patient's fear of falling off the end of the table is substantially reduced.

Figure 2:
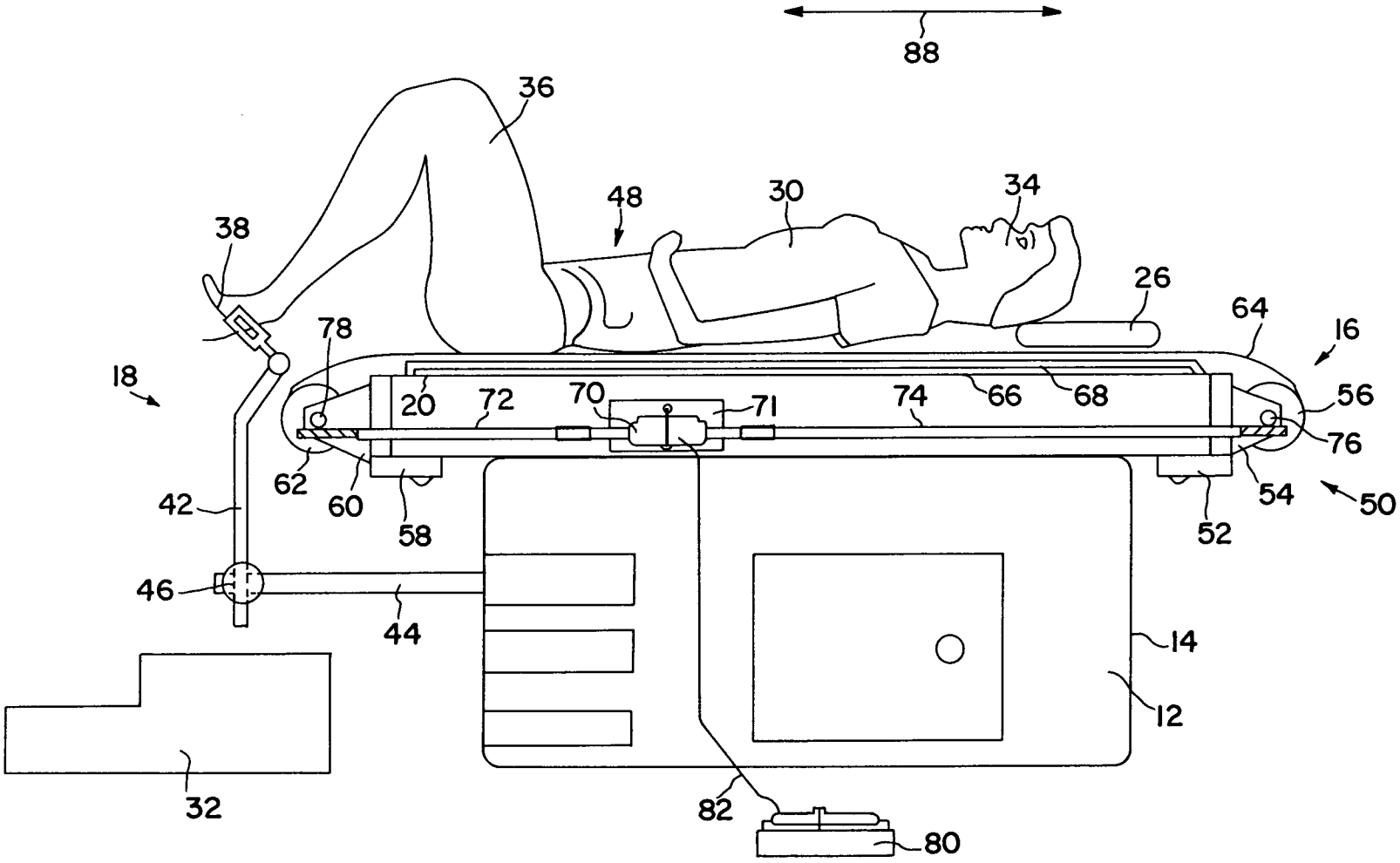
FIG. 2 is an elevational view of a patient examination table containing a patient positioning device according to the invention.
Figure 2A:
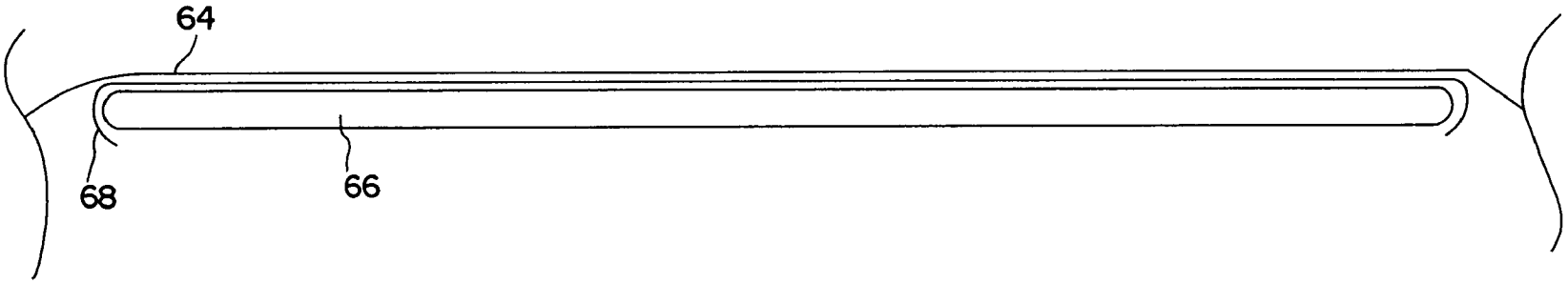
FIG. 2A is an elevational view of a pad, pad cover and elongate web for a patient examination table according to the invention.

As shown in FIG. 2, a patient positioning apparatus 50 according to the invention first end 16 of the table 10 preferably includes a first table attachment device 52 containing a first reel member 54 supporting a first reel 56 rotatably mounted on the first reel member 54. A second table attachment device 58 containing a second reel member 60 and a second reel 62 rotatably mounted on the second reel member 60 is attached on the second end 18 of the table 10. An elongate web 64 is preferably attached to at least one of the reels 56 or 62, and preferably to both reels 56 and 62. The elongate web 64 overlies a table pad 66 carrying a pad cover 68 adjacent the table top 20.

A drive mechanism 70 such as an electric motor is attached to the side of table 10 by means of a bracket 71. First and second connecting rods, cables or flexible shafts 72 and 74 are connected to a drive shaft of the drive mechanism 70. At least one of the first or second flexible shafts 72 or 74 is coupled to a first or second gear drive 76 or 78 which in turn is connected to first or second reels 56 and 62. Activation of the drive mechanism 70 therefore causes rotation of the reel 56 or 62 which is attached to the web 64 thereby providing movement of web 64 relative to the table pad 66. Activation of the drive mechanism 70 is preferably by way of a foot operated switch 80 which is connected by electrical conduit 82 to the drive mechanism 70. Pressure applied to the foot activated switch 80 completes a circuit which causes rotation of the shafts of the drive mechanism 70 which are connected to the first and second flexible shafts 72 or 74 which thereby cause rotation of the first and second reels 56 and 62 which are coupled to the flexible shafts 72 or 74.

Figure 3:
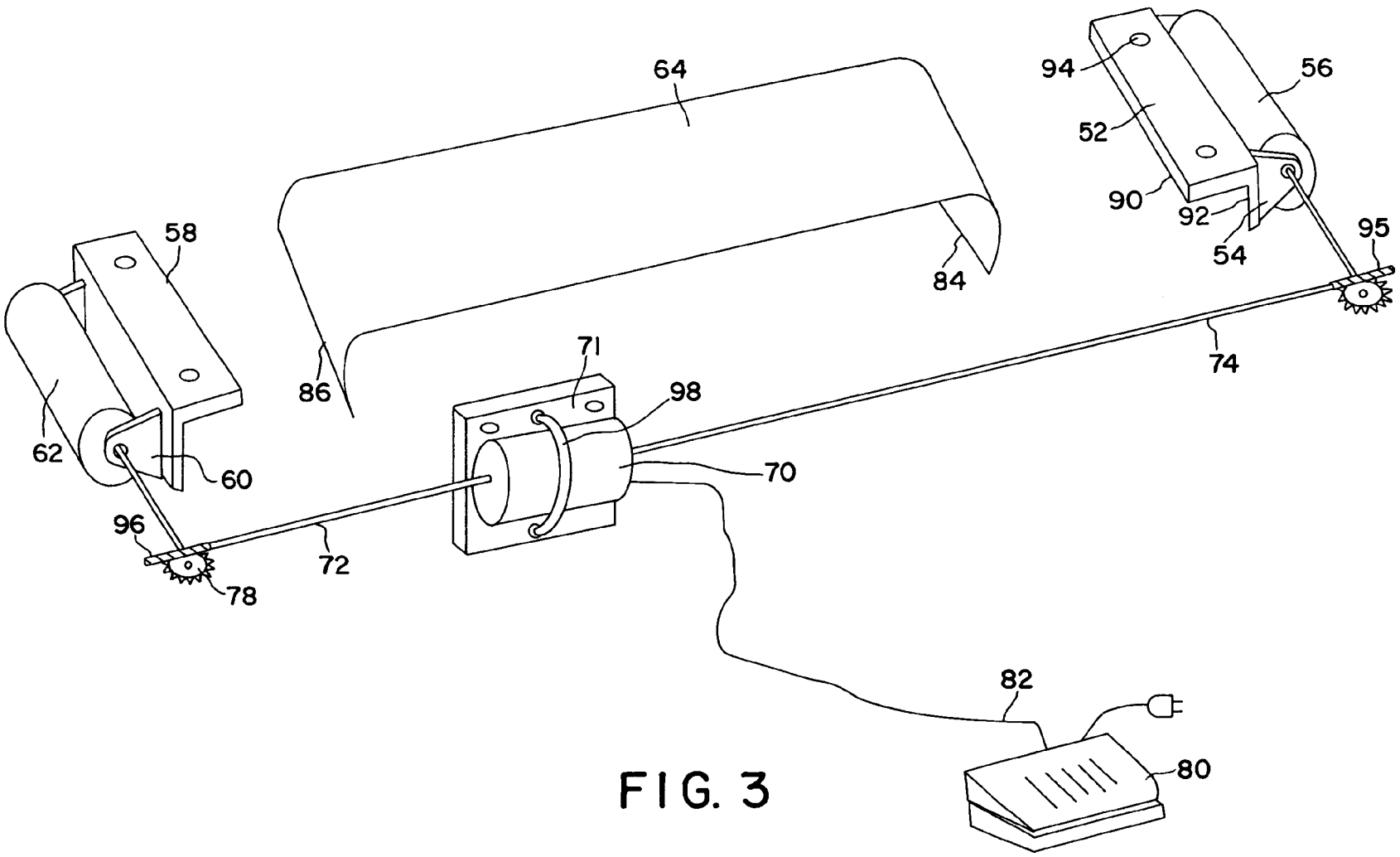
FIG. 3 is an exploded view of components of the positioning device according to the invention.
Figure 4:
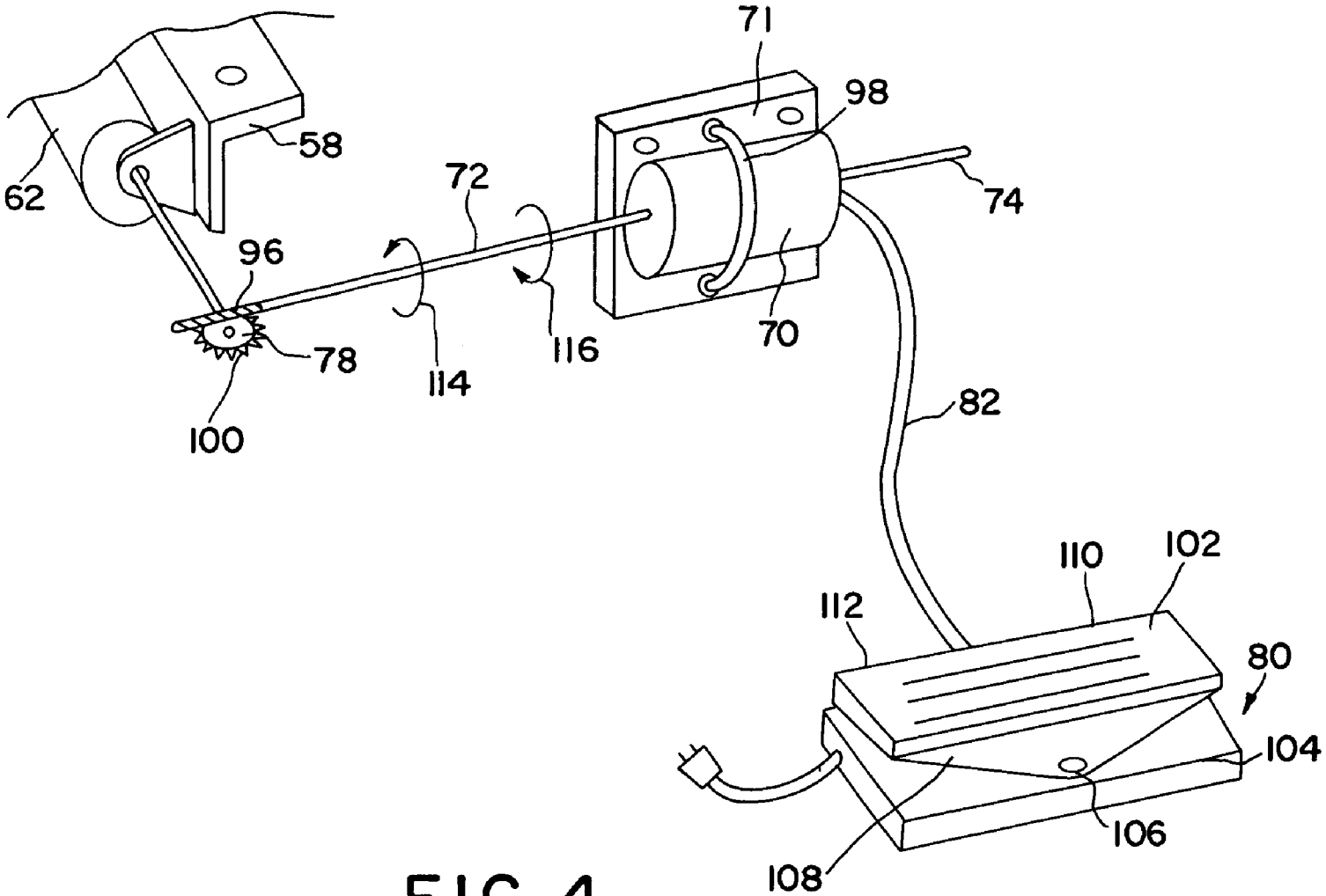
FIG. 4 is a partial perspective view of a drive mechanism for a patient positioning device according to the invention.

Details of the individual portions of the apparatus 50 may be seen by reference to FIGS. 3 and 4. As set forth above, the apparatus includes an elongate web 64 which is made of a of woven or non-woven fabrics selected from satin, polyfluorinated polymers such as a polymer available from DuPont Company of Wilmington, Delaware under the tradename TEFLON, and the like. Any suitable relatively slick or low friction web may be used as web 64. The web 64 overlies a table pad cover 68 which may be made of the same or similar material in order to reduce the friction between the table pad cover 68 and web 64. The most preferred material for the web 64 and table pad cover 68 is satin available from any fabric store. The web 64 preferably has a width of from about 20 inches to about 25 inches and a thickness of from about 0.5 to about 1.5 millimeters.

A first end 84 of web 64 is fixedly attached to a reel such as first reel 56 so that rotation of the first reel 56 will cause the web 64 to move relative to the table top 20. It is particularly preferred to attached second end 86 of web 64 to second reel 62 for forward and reverse movement of web 64 indicated by arrow 88 (FIG. 2). The first and second reels 56 and 62 are supported by first and second reel members 54 and 60 which are fixedly attached to first and second table attachment devices such as angle brackets 52 and 58 each having a horizontal member 90 attached to a vertical member 92. The angle brackets 52 and 58 include apertures 94 for attaching the angle brackets 52 and 58 to the underside portion or end portion of an examination table 10. In the case of attachment to an end portion of an examination table 10, the angle brackets 52 and 58 are may be rotated 90 degrees and the first and second reel members 54 and 60 are attached to the horizontal members 90 rather than vertical members 92.

One or both of the reels 56 or 62 may include a first or second gear drive 76 or 78 which intermeshes with a first or second worm gear 95 or 96 attached to ends of flexible shafts 72 and 74. While shafts 72 and 74 are described as flexible shafts so that one or more portions of the examination table 10 may be raised or lowered without disconnecting the shafts from the reels 56 or 62, it will be recognized that two rigid shafts or one flexible and one rigid shaft may be used for tables which have no movable sections or only one movable section.

Each of the shafts 72 and 74 is operatively connected to a single drive mechanism 70 such as an electric motor (FIG. 4) or the shafts 72 and 74 may be connected to their own separate electric motors. Drive mechanism 70 may be any suitable drive motor such as used in automobiles for electronic seat adjustment. A preferred drive mechanism is a reversible ¼ horsepower electric motor Model D761 having a double shaft available from Fasco Industries of St. Louis, Mo. The motor of the drive mechanism 70 is preferably a reversible motor so that the shafts 72 and 74 may be rotated in a clockwise or counter-clockwise direction.

The drive mechanism 70 is attached to the side portion of the examination table by any suitable means such as bracket 71 and clamp 98. As shown in FIG. 4, the drive mechanism 70 is preferably directly coupled to a shaft or flexible cable 74 which includes on one end thereof a worm gear 96 which intermeshes which a toothed gear 100 attached to an end of reel 62.

Drive mechanism 70 is connected by means of electrical conduit 82 to a foot operated switch 80. Switch 80 may be a rocker foot switch from Highly Electrical Co., Ltd. of Ft. Lauderdale, Fla., or any suitable switch which enables momentary electrical contact to cause rotational adjustments of the shafts 74 for relatively small rotational adjustments of the reels 62. The switch 80 preferably includes contacts for forward or reverse rotation of shafts 74. Foot switch 80 preferably contains a rocking pad 102 which is hingedly connected to the base 104 of the switch 80 by means of spindle 106. The spindle 106 is inserted in an triangularly shaped bracket 108 which enables the rocking pad 102 to be rotated about the spindle 106 by applying pressure to forward portion 110 or reverse portion 112 of the pad 102. Pressure applied to forward portion 110 causes rotation of drive mechanism 70 in one direction as indicated by arrow 114 while pressure applied to reverse portion 112 causes rotation of the drive mechanism 70 in the opposite direction as indicated by arrow 116 (FIG. 4).

A particular advantage of the positioning apparatus of the invention is that it is a relatively simple device which may be attached to a wide variety of conventional examination tables with relatively minor modifications to the table. The apparatus may be assembled from relatively inexpensive components which are readily available and provide a means for repositioning a patient during an examination without investing in an examination table specially designed and built for such application.

Although the invention has been described with a certain degree of particularity with respect to preferred embodiments thereof, it will be recognized that various modifications, additions, substitutions and deletions may be made by those of ordinary skill in the art without departing from the spirit and scope of the claimed invention.

What is claimed is:

1. A kit for attachment to an examination table for examining a patient in the lithotomy position, the kit comprising: a first table attachment device containing at least a first reel member and a first reel rotatably mounted on the first reel member, the first table attachment device being adaptable for attachment to a first end of the examination table; a second table attachment device containing a second reel member and a second reel rotatably mounted on the second reel member, the second table attachment device being adaptable for attachment to a second end of the examination table; an elongate web attached to the first reel member adjacent to and overlying an examination table pad cover, the table pad cover being made of a slick or low friction material; a reversible electric drive mechanism connected to the first reel for rotating the first reel and moving the web relative to the pad cover between the first and second ends of the examination table; and a foot switch for reversing the drive mechanism, the kit being adaptable for attachment to an examination table.

2. The kit of claim 1 wherein the drive mechanism further comprises a motor having a rotatable shaft and a worm gear drive attached to the shaft.

3. The kit of claim 2 wherein the shaft comprises a rigid shaft attached to one end of a flexible cable wherein the worm gear drive is connected to an opposing end of the flexible cable.

4. The kit of claim 3 wherein the worm gear rotates a toothed gear attached to the first reel for rotating the first reel.

5. The kit of claim 1 wherein the drive mechanism comprises a motor having first and second rotatable shafts, and worm gears attached to each of the shafts.

6. The kit of claim 5 wherein each shaft comprises a rigid shaft attached to one end of a flexible cable wherein the worm gear drive is connected to an opposing end of the flexible cable.

7. The kit of claim 1 wherein the first and second reels are attached to the web.

8. The kit of claim 1 wherein the first and second table attachment devices comprise angle brackets having a horizontal member and a vertical member attached to the horizontal member wherein the horizontal member of each table attachment device is fixedly attached to an examination table.

9. The kit of claim 8 wherein the first and second reels are rotatably attached to the vertical members of the attachment devices.

10. The kit of claim 1 wherein the elongate web and pad cover are comprised of woven or non-woven fabrics selected from satin and polyfluorinated polymers.

11. The kit of claim 10 wherein the pad cover is fixedly attached to the table pad.

12. In a method for examining a patient in a lithotomy position, the improvement comprising:

providing a kit for attachment to a lithotomy examination table, the kit including a first table attachment device containing at least a first reel member and a first reel rotatably mounted on the first reel member, the first table attachment device being adaptable for attachment to a first end of the examination table; a second table attachment device containing a second reel member and a second reel rotatably mounted on the second reel member, the second table attachment device being adaptable for attachment to a second end of the examination table; an elongate web attached to the first reel member adjacent to and overlying an examination table pad cover, the table pad cover being made of a slick or low friction material; a reversible electric drive mechanism connected to the first reel for rotating the first reel and moving the web relative to the pad cover between the first and second ends of the examination table; and a foot switch for reversing the drive mechanism, the kit being adaptable for attachment to an examination table;

attaching the kit to the examination table;

placing the patient on the elongate web in an examination position; and operating the electric drive mechanism to rotate the first reel thereby moving the web relative to the pad cover and the patient lying on the web during the examination procedure.

13. The method of claim 12 wherein the first and second reels are attached to the web.

14. The method of claim 12 further comprising operating the drive mechanism in forward and reverse directions to reposition the patient during examination.

15. The method of claim 12 wherein the drive mechanism includes a rigid shaft attached to one end of a flexible cable containing a worm gear drive on an opposing end thereof and the examination table includes a tiltable section, further comprising tilting the tiltable section of the examination table to an acute angle relative to a horizontal plane.

16. The method of claim 12 wherein the elongate web and pad cover are comprised of woven or non-woven fabrics selected from satin and polyfluorinated polymers.

17. The method of claim 12 wherein the elongate web and pad cover are comprised of materials which exhibit relatively low friction relative to one another for easy movement of the web relative to the pad cover when examining a patient lying on the examination table.

* * * * *